US006802438B2

(12) United States Patent
Thompson

(10) Patent No.: US 6,802,438 B2
(45) Date of Patent: Oct. 12, 2004

(54) PRESSURIZED DRINKING MUG

(76) Inventor: Garey Thompson, P.O. Box 231167, Hartford, CT (US) 06123

( * ) Notice: Subject to any disclaimer, the term of this patent is extended or adjusted under 35 U.S.C. 154(b) by 95 days.

(21) Appl. No.: 10/336,166

(22) Filed: Jan. 6, 2003

(65) Prior Publication Data

US 2004/0129714 A1 Jul. 8, 2004

(51) Int. Cl.[7] ..... B67D 5/64

(52) U.S. Cl. ..... 222/175; 222/464.1; 222/465.1; 220/709

(58) Field of Search ..... 220/709; 222/175, 222/464.1, 465.1

(56) References Cited

U.S. PATENT DOCUMENTS 2,766,910 A * 10/1956 Bauerlein ..... 222/129.2
D265,373 S * 7/1982 Christensen ..... D7/668
5,067,637 A * 11/1991 Aurness et al. ..... 222/175
5,101,998 A * 4/1992 Hwang ..... 431/343
5,478,015 A * 12/1995 Black ..... 239/154

* cited by examiner

*Primary Examiner*—Joseph Man Moy

(57) ABSTRACT

Pressurized Drinking Mug with a drinking mug capable of retaining a liquid. The mug has an attached hollow handle. The mug also has a removable, replaceable lid. The hollow handle contains a standard air pump mechanism that creates positive air pressure inside the mug. The lid has a liquid retaining reservoir that has a rigid straw portion extending down to the bottom of the mug and also extends upward to a removable replaceable flexible straw. The flexible straw is capable of being pinched closed or opened by a pinch valve so that when the pinch valve is opened, the liquid is forced up through the straw to the user's mouth. The rigid straw portion also contains a side port that can be restricted by a removable, replaceable plug. The port is also capable of retaining a push button valve that allows the pressurized liquid to be pumped into the reservoir.

5 Claims, 7 Drawing Sheets

PRESSURIZED DRINKING MUG

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of drinking vessels and more specifically to a pressurized drinking mug. Drinking cups and mugs of various designs have been available for hundreds of years and have been made from a variety of materials including glass, ceramic, plastic and metal. Mugs traditionally have an attached handle so that the user does not have to grasp the entire drinking vessel. In more recent times, mugs having a removable lid have been manufactured. These types of mugs are especially convenient for travelers who wish to take a beverage, such as coffee, with them.

Another common accessory for a cup or mug is a straw from which to sip a beverage contained within the cup without actually tilting the cup.

A deficiency in traditional drinking straws is that the user must create a suction by breathing in thereby forcing liquid up through the straw and into the user's mouth. Some individuals may have difficulty with this sucking activity. Additionally, it would be a novel experience for a liquid to be delivered to a person's mouth without sucking. Another deficiency in the prior technology is that when a person uses a traditional lid type travel mug filled with hot coffee, he or she may burn his or her mouth because the hot coffee does not have a chance to cool before exiting the small port found in standard travel mugs.

BRIEF SUMMARY OF THE INVENTION

The primary object of the invention is to provide a drinking mug that allows the user to drink as needed from a straw without sucking.

Another object of the invention is to provide a drinking mug that allows a user to cause a limited amount of liquid such as hot coffee or tea to enter a top reservoir upon demand so that the liquid may be drunk in a fashion that lets the user infuse cool air along with the hot liquid so that the user does not burn his or her tongue.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a pressurized drinking mug comprising: a drinking mug capable of retaining a liquid, said mug having an attached hollow handle, said mug also having a removable, replaceable lid , said hollow handle containing a standard air pump mechanism, said pump capable of creating positive air pressure inside said mug, said lid having a liquid retaining reservoir, said reservoir having a rigid straw portion extending down to the bottom of said mug, said rigid straw portion also extending upward to a removable replaceable flexible straw, said flexible straw capable of being pinched closed or opened by a pinch valve so that when said pinch valve is opened, said liquid is forced up through said straw to the user's mouth, said rigid straw portion also containing a side port, said side port capable of being restricted by a removable, replaceable plug, and said side port also capable of retaining a push button valve that allows said pressurized liquid to be pumped into said reservoir so that the user can drink a small portion of the said liquid while the major portion of said liquid remains inside said mug.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
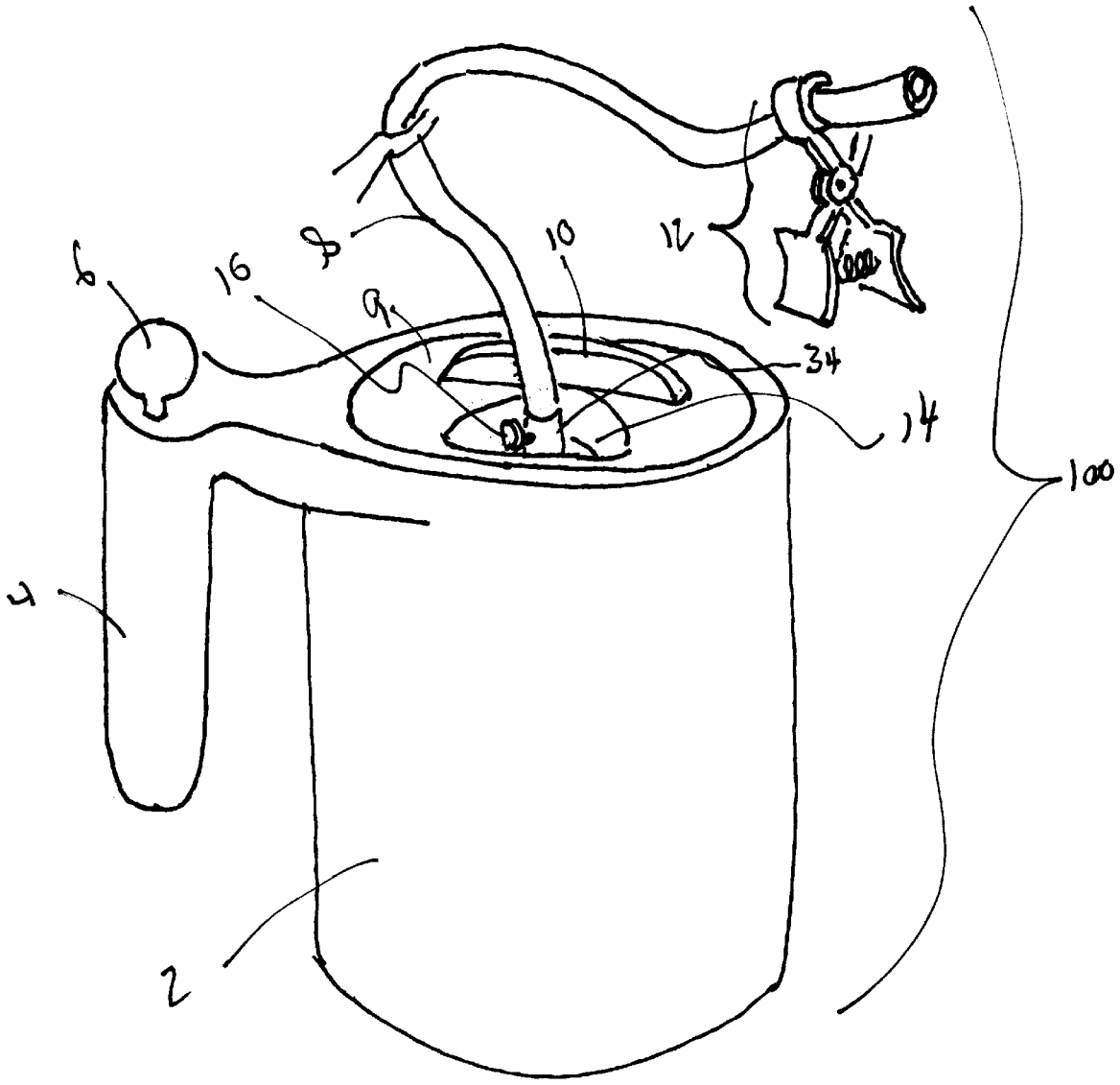
FIG. 1 is a perspective view of the invention using a piston type pump.
Figure 2:
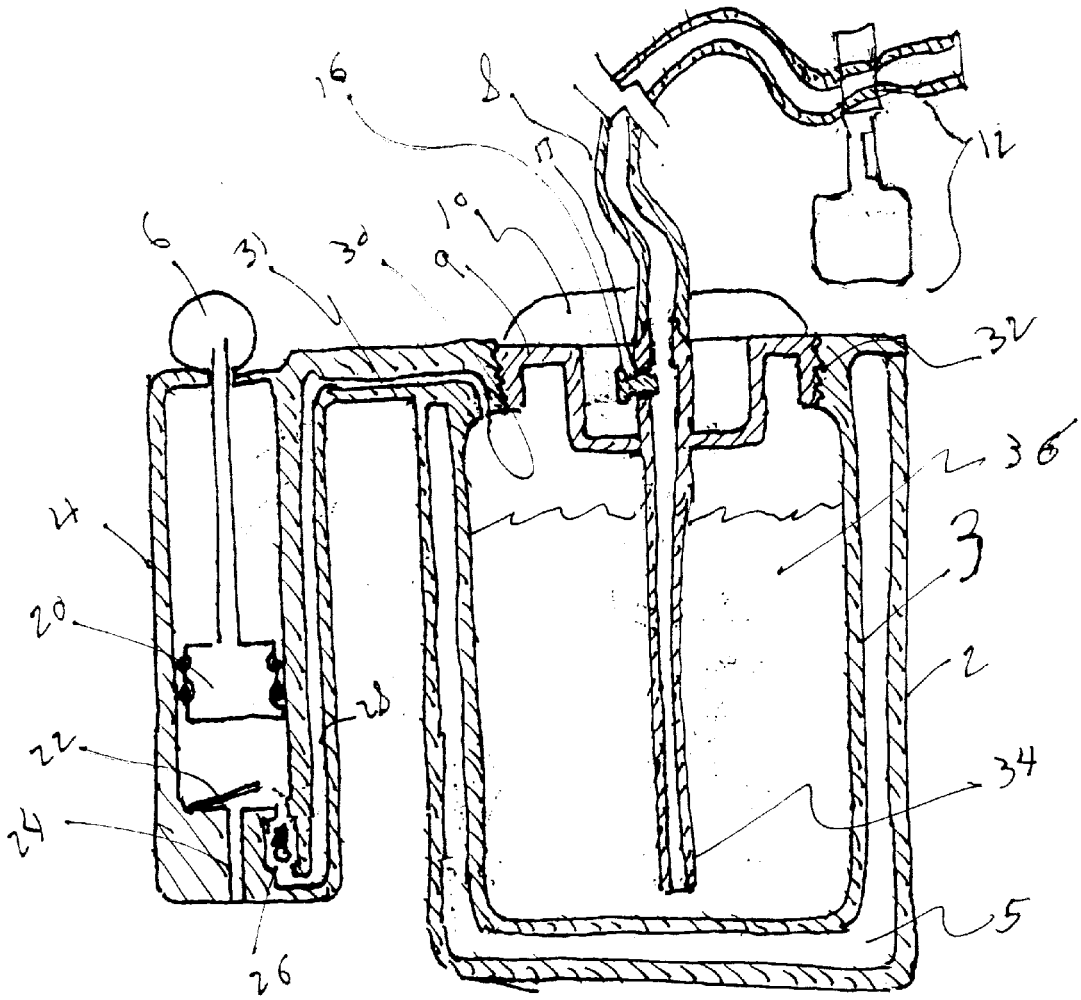
FIG. 2 is a side section view of the invention using a piston type pump.
Figure 3:
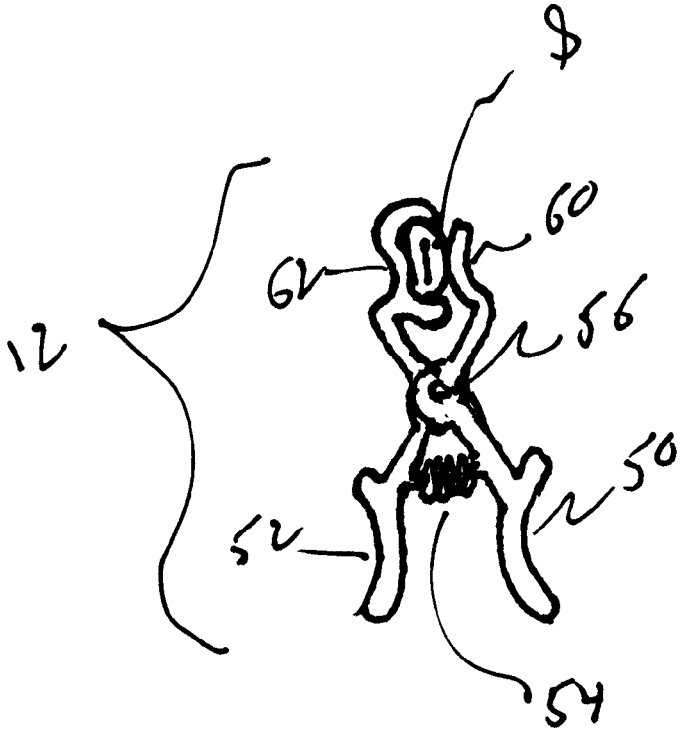
FIG. 3 is a side view of the pinch valve in the closed position.
Figure 4:
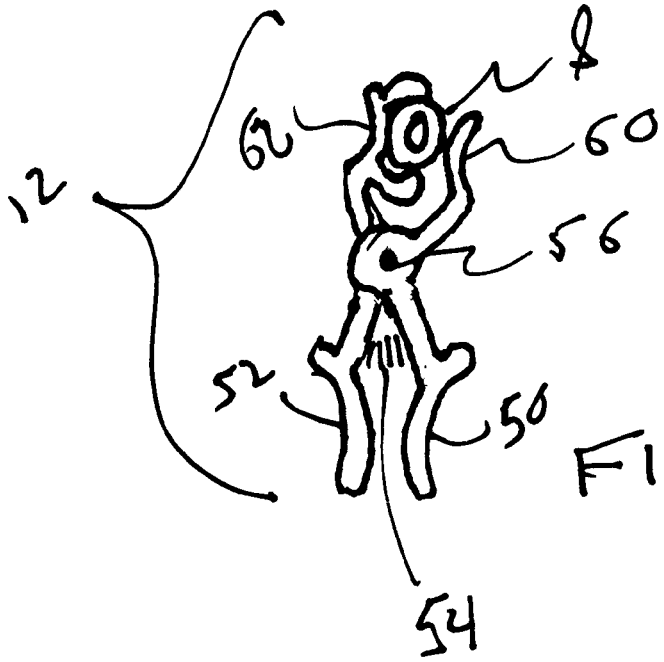
FIG. 4 is a side view of the pinch valve in the open position.
Figure 5:
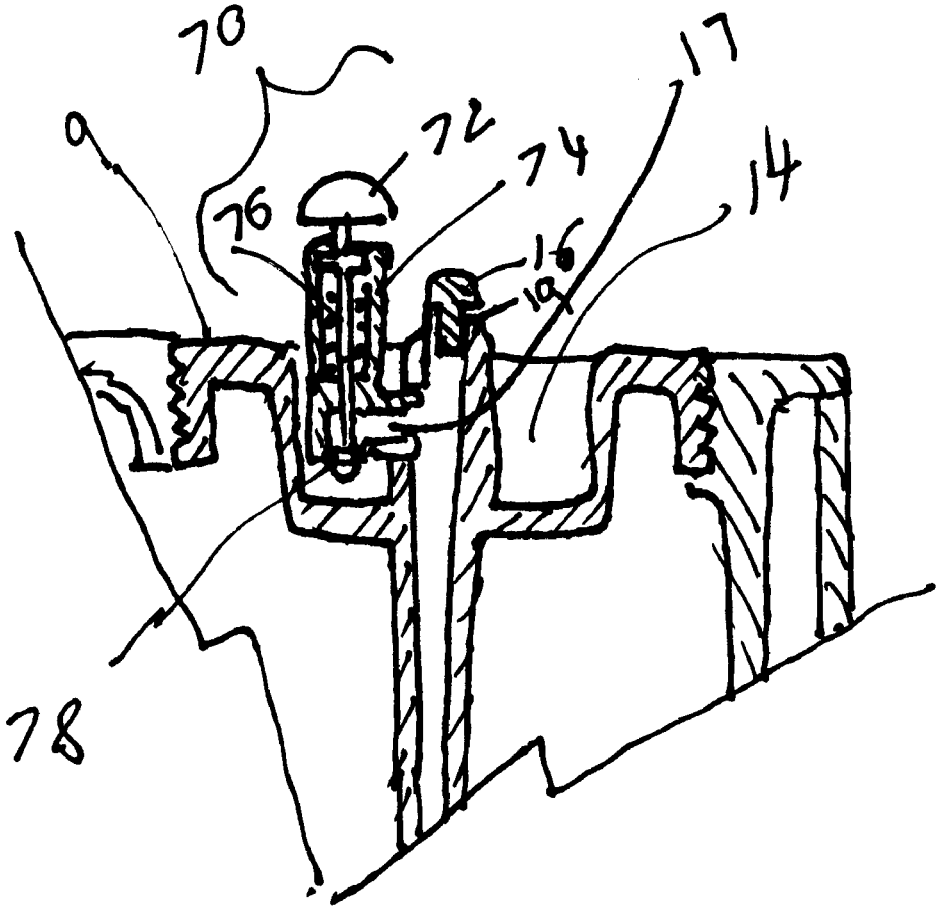
FIG. 5 is a partial side section view showing the push button valve.
Figure 6:
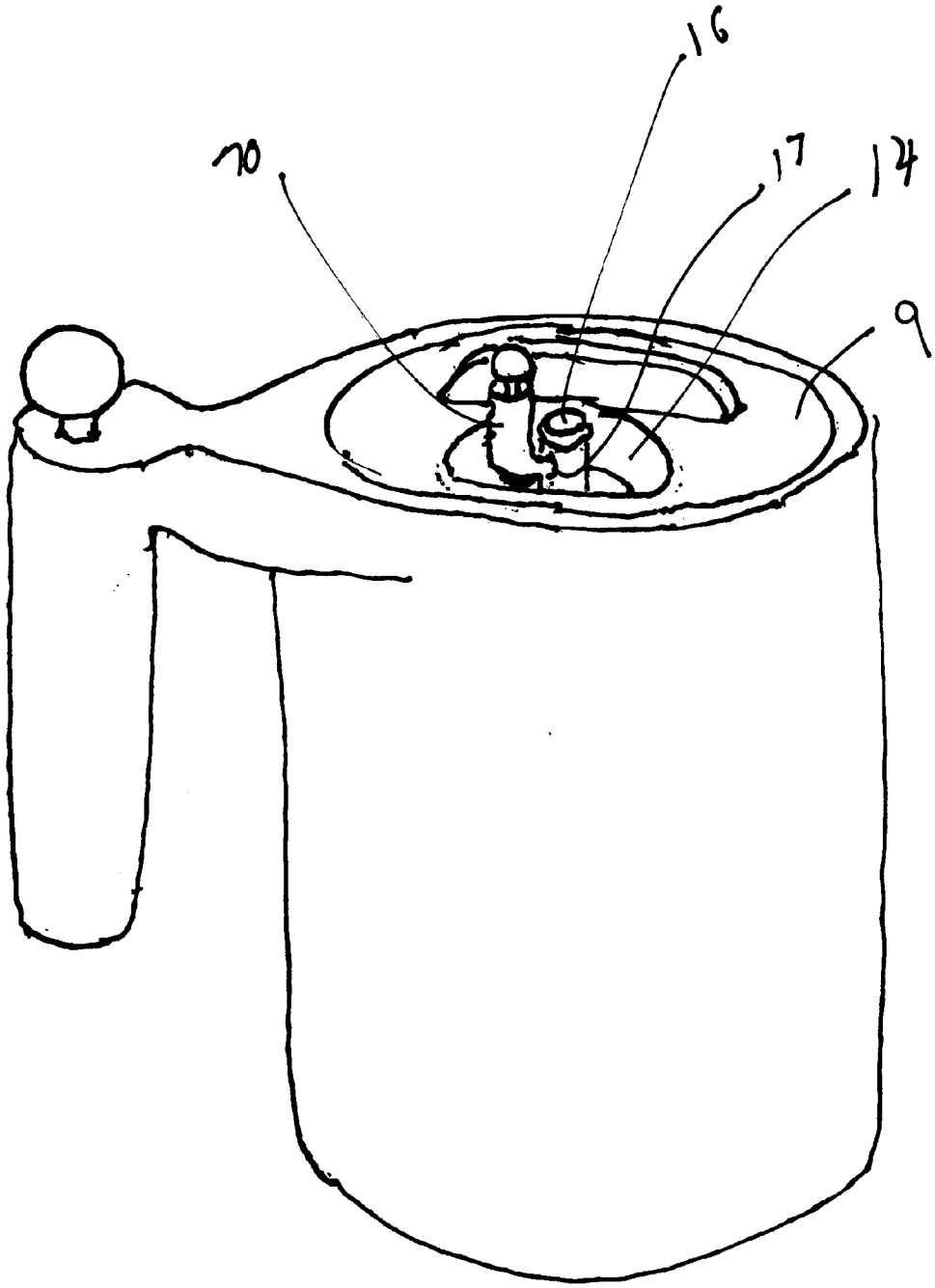
FIG. 6 is perspective view of the invention with the push button valve in place.
Figure 7:
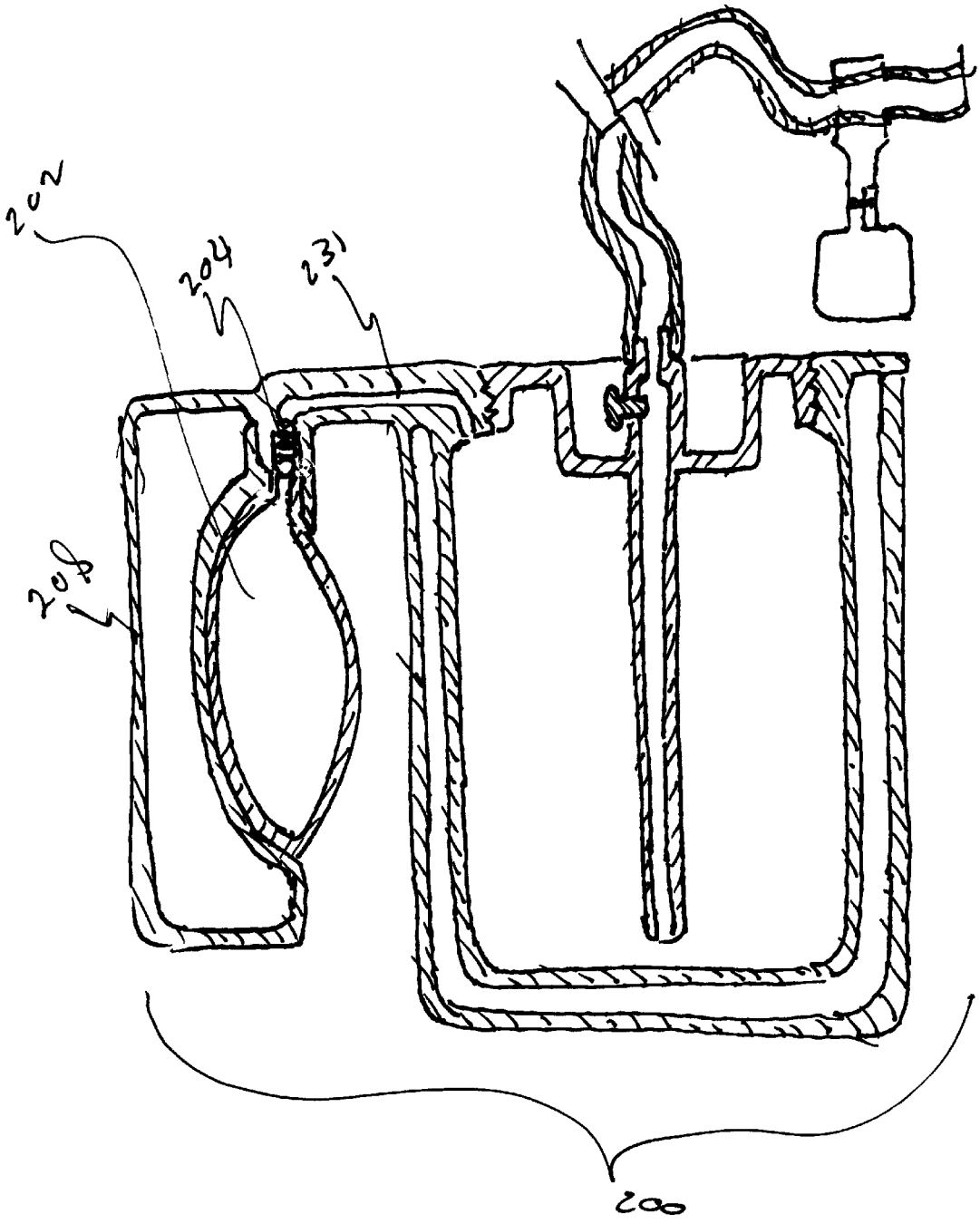
FIG. 7 is a side section view of the invention using a rubber bladder type pump.
Figure 8:
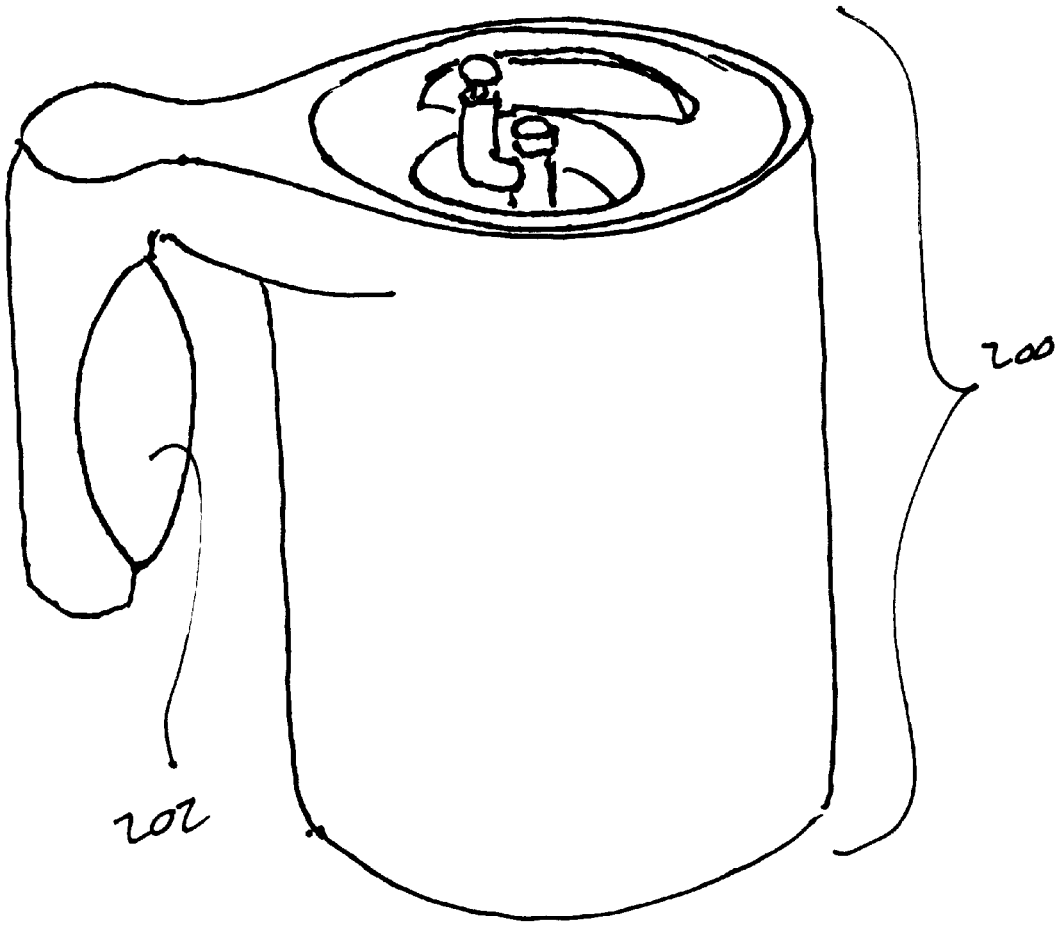
FIG. 8 is a perspective view of the present invention using the rubber bladder type pump

Referring now to FIG. 1 we see a perspective view of the pressurized drinking mug of the present invention 100. The mug consists of a standard drinking vessel 2 having an attached handle 4. A knob 6 on top of handle 4 can be raised and lowered creating a positive air pressure to build up in mug body 2. A removable, replaceable lid 9 holds pressure inside mug body 2. A flexible straw 8 extends from a rigid straw 34 and is closed off by a pinch valve assembly 12. When a person pressurizes the vessel 2, liquid contained inside the mug 2 is forced up straw 8 and can be released into a person's mouth by pressing pinch valve assembly 12. FIG. 2 shows a side section view of the present invention. Handle portion 4 includes a standard piston pump comprised of piston 20, check valves 22, 26 vent 24. When the user pulls up on, and pushes down on handle 6, piston 20 forces air through check valve 26 and into channel 28 and emptying out of orifice 30 inside cup portion 3. This particular mug shows a double walled construction where outer wall 2 and inner wall 3 create a gap 5 that acts as an insulator. Of course a single walled mug can also be made. Lid portion 9 can be unscrewed by threads 32 when the user twists rib 10. The resulting pressure causes liquid 36 to be forced up inner straw 34 and through flexible straw 8. The liquid can exit straw 8 when pinch valve assembly 12 is opened. plug 16 closes off side port 17. FIG. 3 shows pinch valve assembly 12 in the closed position. Straw 8 is pinched closed. The pinch valve assembly 12 is comprised of a pair of rigid arms each having an upper pinch portion 60, 62 and a lower finger pressing portion 50, 52. A compression spring 54 holds the pinch portions 60, 62 in the closed positron thereby preventing liquid from escaping tube 8 as shown in FIG. 3. When the user presses in on finger portion 50, 52, tube 8 is allowed to open as shown in FIG. 4. Partial side section shown in FIG. 5 shows a configuration of the present invention where plug 16 as been removed from side port 17 and placed in top straw port 19. A push button valve assembly 70 has been inserted into port 17. Valve 17 includes a valve stem and push button 72, a compression spring 76 and a rubber closure ring 78. When the button 72 is pushed, closure ring 78 is opened thereby allowing pressurized liquid to exit port 17 and fill upper reservoir 14. If the liquid is hot, such as hot coffee, the liquid can be sipped along with air as in a normal coffee cup thereby reducing the chance of burning the tongue or lips. In comparison, a standard commuter mug forces the user to sip directly from the hot vessel without adding cool air, thereby increasing the chance of burning the tongue. FIG. 6 shows a perspective view of the invention 100 with the push button valve assembly 70 in place. FIG. 7 shows an alternate embodiment of the present invention 200 where the pump is a rubber bladder 202. In this case the user presses on the bladder while holding onto handle 208. Air is forced through check valve 204 and through channel 231 to the inside of the mug as described above. FIG. 8 shows a perspective view of the alternate embodiment 200 of the present invention.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Pressurized Drinking Mug comprising:

a drinking mug capable of retaining a liquid;

said mug having an attached hollow handle;

said mug also having a removable, replaceable lid;

said hollow handle containing a standard air pump mechanism;

said pump capable of creating positive air pressure inside said mug;

said lid having a liquid retaining reservoir;

said reservoir having a rigid straw portion extending down to the bottom of said mug;

said rigid straw portion also extending upward to a removable replaceable flexible straw;

said flexible straw capable of being pinched closed or opened by a pinch valve so that when said pinch valve is opened, said liquid is forced up through said straw to the user's mouth;

said rigid straw portion also containing a side port;

said side port capable of being restricted by a removable, replaceable plug; and said side port also capable of retaining a push button valve that allows said pressurized liquid to be pumped into said reservoir so that the user can drink a small portion of the said liquid while the major portion of said liquid remains inside said mug.

2. Pressurized Drinking Mug as claimed in claim 1 wherein said pump is a piston type pump.

3. Pressurized Drinking Mug as claimed in claim 1 wherein said pump is a rubber bladder type pump.

4. Pressurized Drinking Mug as claimed in claim 1 wherein said mug body is comprised of a double walled construction to provide insulation.

5. Pressurized Drinking Mug as claimed in claim 1 wherein said drinking mug allows a person to drink liquid from a straw without the act of sucking.

* * * * *